US006032983A

United States Patent [19]

Lanter

[11] Patent Number: 6,032,983

[45] Date of Patent: Mar. 7, 2000

[54] EMERGENCY COLOR AND TACTILE CODED IDENTIFICATION PLATE

[76] Inventor: Steven S. Lanter, 8501 Tarbutton Rd., South Vienna, Ohio 45369

[21] Appl. No.: 09/083,917

[22] Filed: May 26, 1998

[51] Int. Cl.[7] ..... B42D 15/00

[52] U.S. Cl. ..... 283/67; 40/200; 40/201; 40/634; 70/454; 70/460; 200/271; 283/70; 283/98; 283/109; 430/495.1

[58] Field of Search ..... 283/67, 70, 107, 283/109, 114, 98; 70/460, 454; 40/200, 201, 205, 634; 200/271; 430/495.1

[56] References Cited

U.S. PATENT DOCUMENTS

| | | | |
|---|---|---|---|
| 213,515 | 3/1879 | Marshall . | |
| 1,692,686 | 11/1928 | Nichols . | |
| 1,816,642 | 7/1931 | Fetter . | |
| 1,868,563 | 7/1932 | Cicourel . | |
| 1,948,985 | 2/1934 | Howe . | |
| 2,201,127 | 5/1940 | Schecter . | |
| 2,432,498 | 12/1947 | Bloomfield . | |
| 3,123,926 | 3/1964 | Jacobson . | |
| 3,204,360 | 9/1965 | Ehmcke . | |
| 3,895,987 | 7/1975 | Loreck | 156/223 |
| 5,393,099 | 2/1995 | D'Amato | 283/67 |
| 5,588,679 | 12/1996 | Skov et al. | 283/67 |
| 5,692,327 | 12/1997 | Wynne et al. | 40/205 |
| 5,824,116 | 10/1998 | Zutler | 8/471 |
| 5,833,350 | 11/1998 | Moreland | 362/95 |
| 5,899,012 | 5/1999 | Crum | 40/716 |

FOREIGN PATENT DOCUMENTS

| | | |
|---|---|---|
| 1061552 | 4/1954 | France . |
| 535831 | 4/1941 | United Kingdom . |

*Primary Examiner*—Andrea L. Pitts
*Assistant Examiner*—Monica Smith
*Attorney, Agent, or Firm*—Richard C. Litman

[57] ABSTRACT

An emergency color and tactile coded identification plate comprising a face plate, a clear tamper resistant plastic center, and a back plate is used to control access to and from locations within and around a secured facility. The face plate has configured openings that correspond to configured markings on the back plate such that the configured markings on the back plate fill the configured openings of the face plate when the identification plate is assembled by aligning and bringing the face plate, the clear plastic center, and the back plate into contact with each other to form a single unit. The present invention provides a multiple indicia emergency plate that allows fast identification of the correct key for a specific door in a secured facility that uses both visual and tactile indicia.

8 Claims, 5 Drawing Sheets

EMERGENCY COLOR AND TACTILE CODED IDENTIFICATION PLATE

BACKGROUND OF THE INVENTION

1. Field of the Invention

The present invention relates to an emergency identification plate that is used to identify the correct key for a specific door, and more particularly, an identification plate that uses both color and tactile indicia to match the correct key with the appropriate door.

2. Description of the Related Art

Emergency situations require quick decision making and a rapid response. Any delay, even seconds, in taking decisive action can mean the difference between life and death, and nowhere is this more apparent than in a prison. Access in and out of a prison, and movement within the prison itself is tightly controlled and regulated, and frequently monitored.

A prison is a place of forced confinement with the inmates confined to the prison and their cells by locked doors and guards.

Therefore, the passage through doors within the prison and through doors that provide entry and exit to and from the prison is restricted.

Emergencies arise in prisons just as they do anywhere else;

however, emergencies in a prison present a special set of circumstances and problems not found in most other emergency situations. Even when an emergency occurs in a prison, security must be maintained. Therefore, authorized prison personnel must have rapid but controlled access to critical areas of the prison.

There are a number of emergency situations that can arise as a result of the unique nature of prison itself, for example, prison riots or hostage situations. In either situation, it is necessary for Special Weapons And Tactics (S.W.A.T) teams of law enforcement agencies to have rapid access to any location in the prison.

It is essential to the physical safety of prison personnel and the inmates themselves that the prison have a system whereby the correct key for a specific door can be quickly identified. The identification means must be reliable and tamper proof, and must be operational even in the dark. For example, in the event of a power outage where visual identification is not possible, the identification means must still allow prison personnel to readily identify the correct key on a key chain or ring for a specific door.

The requirement that the identification means allows for tactile identification is further necessitated by the possibility of a fire inside the prison wherein the rooms could become quickly engulfed in smoke resulting in virtually zero visibility. Any method of controlled access must not only be secure and reliable but must meet state and/or federal codes regulating such methods and procedures.

The prior art describes a number of methods and procedures used to identify and match a key with a specific lock or door. For example, U.S. Pat. No. 1,692,686 issued on Nov. 20, 1928 to H. J. Nichols describes a tactual indicating means whereby one of a plurality of keys is readily distinguished from the other keys.

Indicators in the form of rivets are inserted in holes drilled in the head or shank portion of the key. A key is identified by the number of rivets present on the key, for example, the house key has one rivet, the garage key has two rivets, the office key has three rivets, and the desk key has four rivets.

An identification system for identifying particular keys of a group of keys which closely resemble each other is described in U.S. Pat. No. 1,816,642 issued on Jul. 28, 1931 to H. H. Fetter.

Each key has an identifying marker wherein the marker has a strikingly different color than the marker of another key. A recess in the key is filled with a colored enamel molded to a desired shape. The colored enamel extends beyond the surface of the key and has an identifying characteristic shape so that a particular key may be readily selected from a group of keys by sense of touch.

U.S. Pat. No. 3,204,360 issued on Sep. 7, 1965 to C. J.

Ehmcke describes an identification means for keys. The Ehmcke patent describes an identification means that identifies a key for a particular lock by feeling with the fingers and by appearance by giving each key a visually distinguishing characteristic. The identification means consists of a knoblike ornament attached to the key. A particular key can be identified by the specific shape of the knoblike ornament.

French Patent No. 1,061,552 published in April, 1954 to M. D. Ricouard describes a method for identifying a specific key by appearance or by touch. The French patent describes an identification means that consists of either applying a molded plastic of a specific color to the head of the key or by forming distinguishing bumps on the head of the key; for example, in one instance the bumps are round while in another the bumps are square.

The July, 1948 edition of the periodical "Popular Science" on page 120 describes an identification means for keys wherein a particular key and the lock it fits are the same color.

It is clear from the prior art that it is known in the art to use either a color indicator or a tactile indicator or both to match a particular key to a specific lock. However, the present invention addresses a myriad of problems not even considered by the prior art, and provides a practical, effective, and cost efficient solution.

None of the above inventions and patents, taken either singly or in combination, is seen to describe the instant invention as claimed. None of the methods described in the prior art meet or even address the special considerations required of the present invention in order to solve the aforementioned problems. Thus a multiple indicia emergency plate that allows fast identification of the appropriate key for a specific door in a secured facility that uses both visual and tactile indicia is desired.

SUMMARY OF THE INVENTION

Accordingly, it is a principal object of the invention to allow the immediate identification of the appropriate key for a specific door.

It is another object of the invention to provide an identification plate that is tamper resistant.

It is a further object of the invention to provide an identification plate that meets existing state and federal codes Still another object of the invention is to provide an identification plate that allows immediate identification either visually or tactilely.

Still another object of the invention is to provide an identification plate that allows authorized personnel to modify the identification plate with a minimum of time and effort.

It is an object of the invention to provide improved elements and arrangements thereof for the purposes described which is inexpensive, dependable and fully effective in accomplishing its intended purposes.

To meet the above objectives the present invention provides an identification plate assembly comprising a face plate, a clear tamper resistant plastic center, and a back plate. The face plate has configured openings that correspond to configured markings on the back plate such that the configured markings on the back plate fill the configured openings of the face plate when the identification plate is assembled by aligning and bringing the face plate, the clear plastic center, and the back plate into contact with each other to form a single unit.

In an alternate embodiment, the configured markings are placed on a piece of paper having the same dimensions as the other elements of the identification plate assembly. The piece of paper is placed between the back plate and the clear plastic center and the configured markings on the piece of paper fill the configured openings of the face plate when the identification plate is assembled.

The identification plate can also have a base portion that shows either the room name or the room number, or both. The base portion can also be used as an occupancy indicator to show whether a room is occupied or unoccupied. The base portion is created by using two pieces of clear plastic instead of a single piece of clear plastic and placing the labels containing the pertinent information between the bottom portions of the clear plastic pieces. The identification plate with an occupancy indicator requires the use of four pieces of clear plastic and a small detached plate that horizontally slides back and forth.

The components (face plate, clear plastic piece or pieces, and back plate) of the identification plate assembly are secured to one another using security screws that can only be removed using a specific screw driver supplied by the manufacturer of the security screws. Thus, the securing screws are tamper proof. The tamper proof screws and the tamper resistant plastic prevents unauthorized modification of an identification plate.

The above mentioned and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
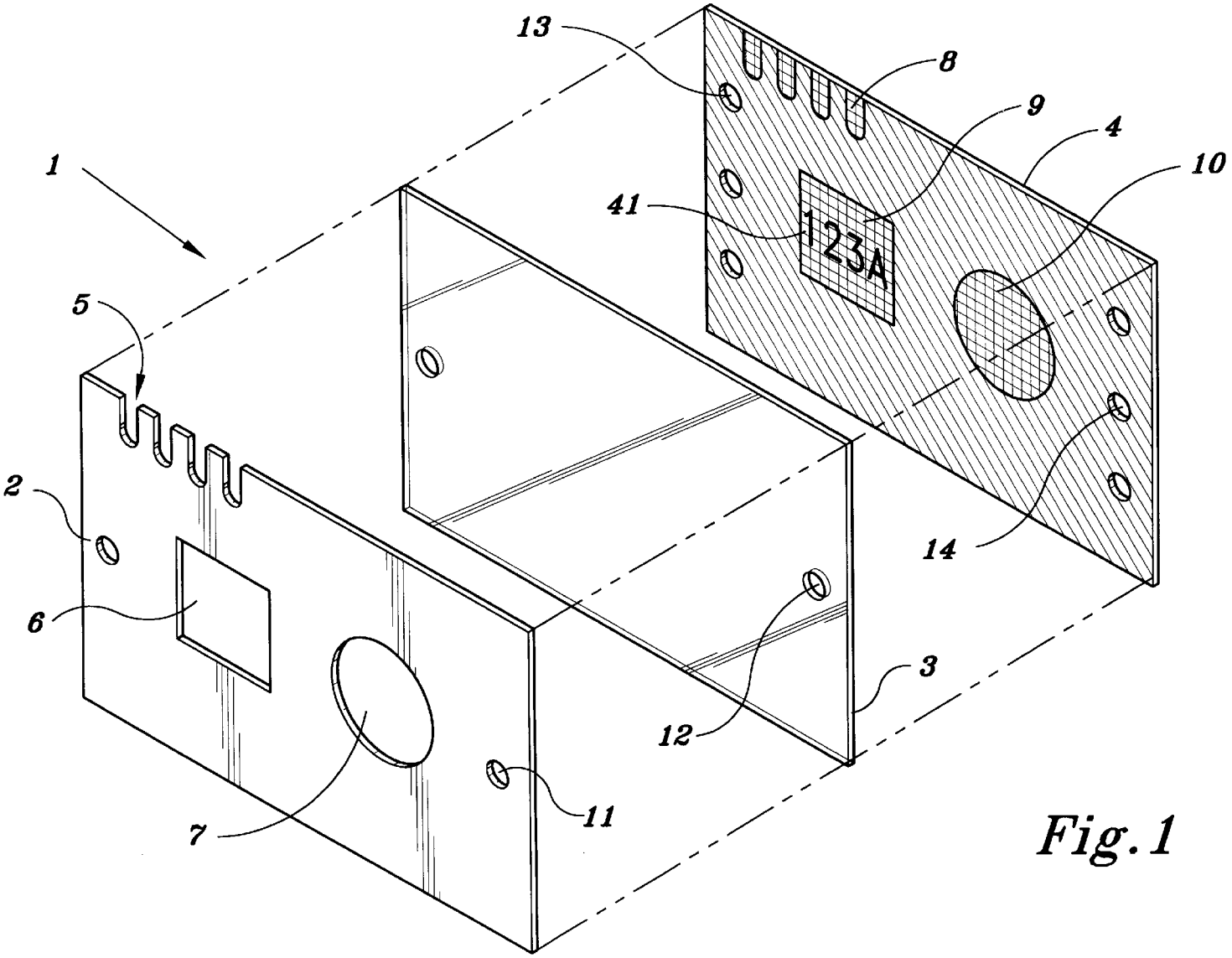
FIG. 1 is an exploded perspective view of an emergency color and tactile coded identification plate assembly according to the present invention.
Figure 7:
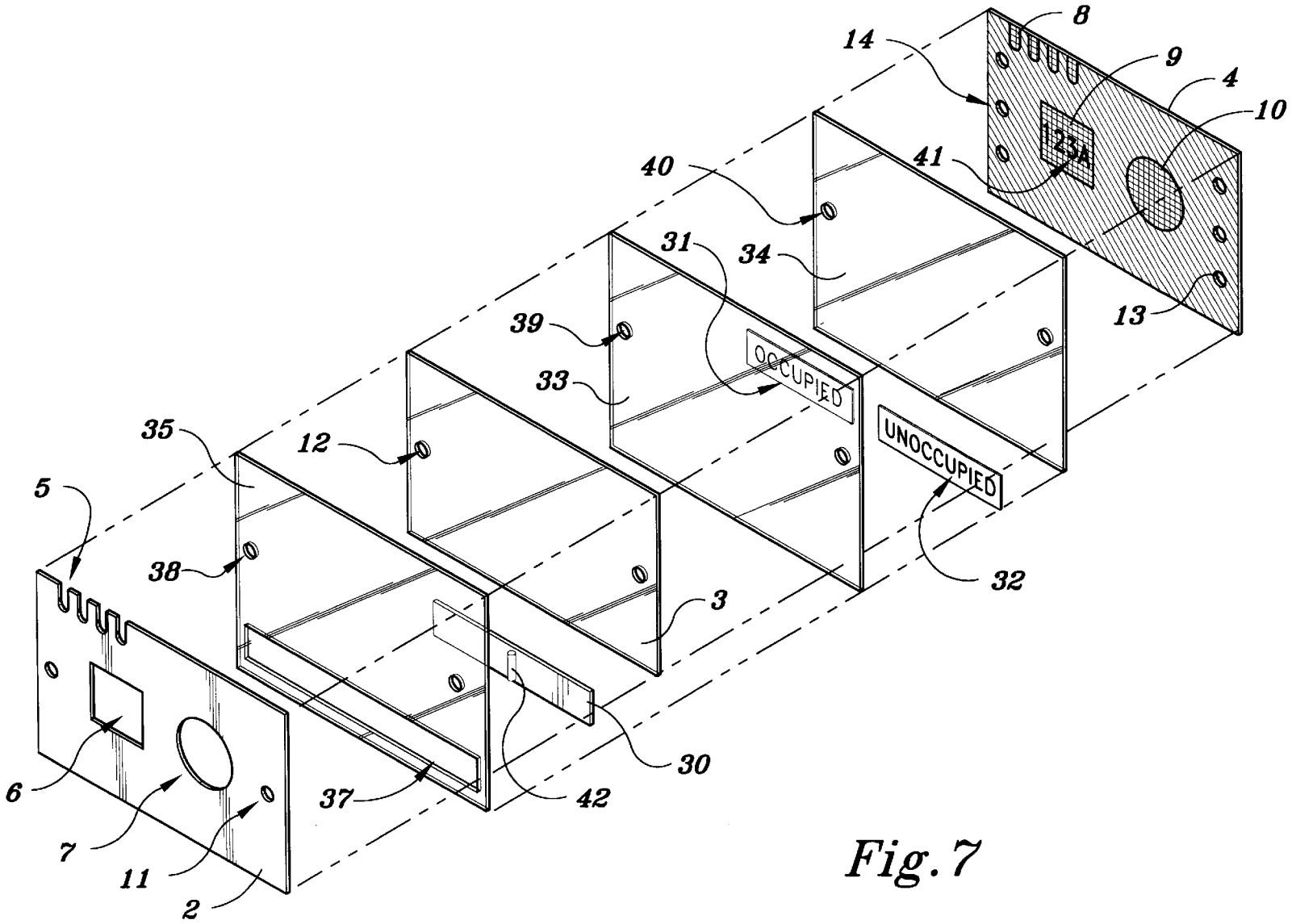
FIG. 7 is an exploded, perspective view of the embodiment depicted in FIGS. 6A and 6B showing the components of the identification plate assembly.

Referring to FIGS. 1 and 7, FIG. 1 is a preferred embodiment of the present invention comprising a face plate 2, a clear tamper resistant plastic center 3, and a back plate 4. The face plate 2 of the identification plate assembly 1 depicted in FIG. 1 has configured openings 5,6,7 with the back plate 4 having configured markings 8,9,10 whose locations and shapes correspond to the locations and shapes of the configured openings 5,6,7 of the face plate 2. The configured marking on the back plate 4 that is square 9 has an alphanumeric label 41 in the center of the marking 9 that shows the room number. FIG. 1 also shows the tapped and threaded holes 11,12,14 for the security screws 16 (FIG. 3A) and the mounting holes 13 used to mount the back plate 4 to the door or adjacent wall (not shown).

FIG. 7 shows an alternate embodiment of the present invention that utilizes multiple clear tamper resistant plastic pieces 3,33,34,35. Three of the clear plastic pieces 33,34,35 are a ½ inch longer than the forth piece of clear plastic 3. The three longer (2½ inches) pieces of clear plastic 33,34,35 have a ⅛ inch thickness while the shorter (2 inches) clear plastic piece 3 has a ¼ inch thickness.

In the embodiment depicted in FIG. 7, one of the longer pieces of clear plastic 35 is disposed in back of the face plate 2. The bottom portion of the front clear plastic piece 35 has a slot 37 that is used to slide the small detached plate 30 horizontally back and forth between two positions that indicate whether or not the room to which entry is sought is occupied. The labels 31,32 indicating the status of the room to which entry is sought are located between the bottom portions of a long intermediate clear plastic piece 33 and a long back clear plastic piece 34 disposed in front of the back plate 4. FIG. 7 also shows the tapped and threaded holes 11,12,14,38,39,40 for the security screws 16 (FIG. 3A) and the mounting holes 13 used to mount the back plate 4 to the door or adjacent wall (not shown).

The configured markings shown in both FIGS. 1 and 7 are made using any conventional coloring means and any conventional LTD. labelling means. The indicia of the identification plate assembly 1 are both visual and tactile. The correct key for a specific door is identified by matching the color of the configured markings with the color of the head of the key 17 (shown in FIG. 3B). Coloring the head of the key 17 is done by simply dipping the head of the key 17 into a can of paint of the desired color. Tactile identification is accomplished by feeling the number of grooves 5 present on the upper left corner of the identification plate assembly 1 and locating the key with the same number of notches (V-shaped grooves) on the head of the key 17 as depicted in FIGS. 3A and 3B.

Figure 5:
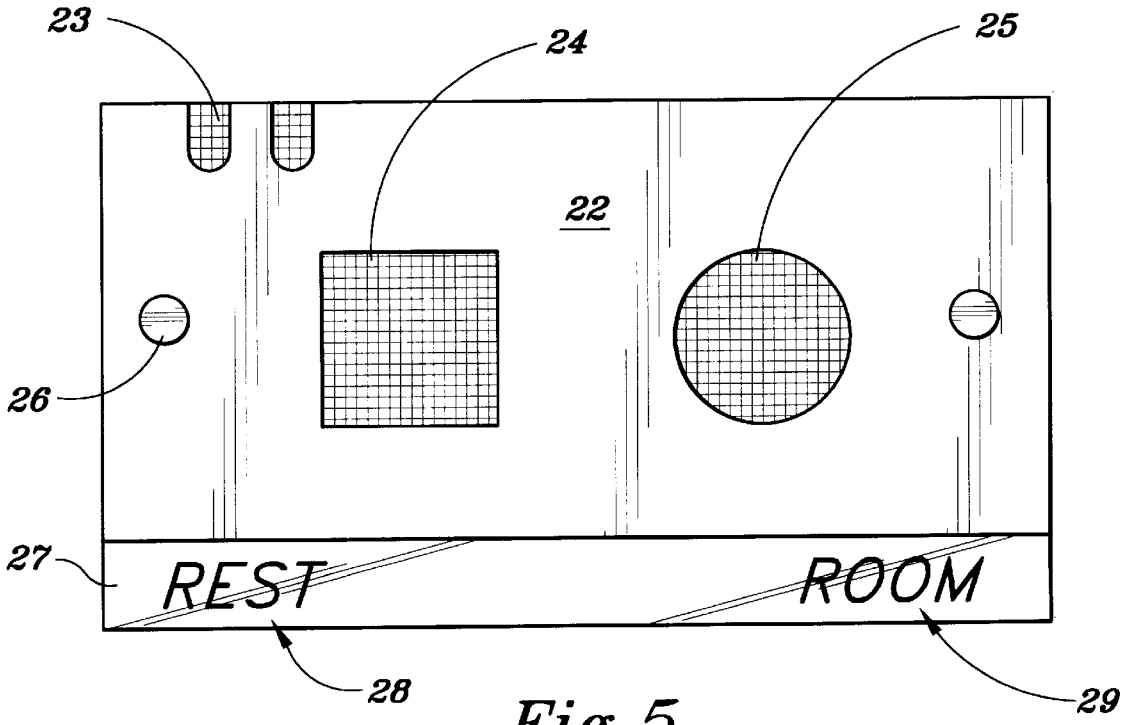
FIG. 5 is a front view of a second alternate embodiment of a fully assembled identification plate assembly that displays the room name and/or number at the base of the identification plate assembly.

Referring to FIG. 5 which shows a front view of a second alternate embodiment that is comprised of a face plate 2, a piece of the longer clear plastic 27, a second piece of the longer clear plastic (hidden), labels 28,29 located near the bottom of the two longer pieces of clear plastic 27 are sandwiched between the two longer pieces of clear plastic 27, and a back plate 4 (shown in FIG. 1). The enclosed labels 28,29 are readily viewable because the bottom portion of the two longer pieces of clear plastic 27 extends beyond the lower boundary of the face plate 2.

Figure 2:
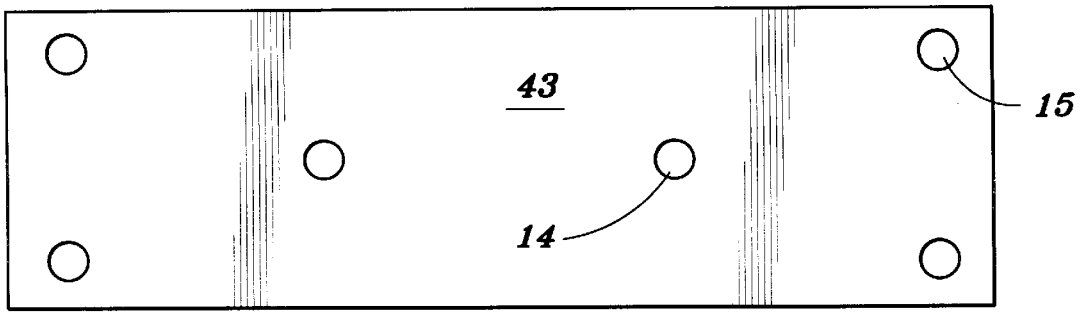
FIG. 2 is a front view of an alternate elongated back plate according to the present invention.

FIG. 2 shows an elongated back plate 43 that is used in an alternate embodiment of the present invention. FIG. 2 also shows the tapped and threaded holes 14 for the security screws 16 (FIG. 3A) and the mounting holes 15 used to mount the back plate 43 to the door or adjacent wall (not shown).

Figure 3A:
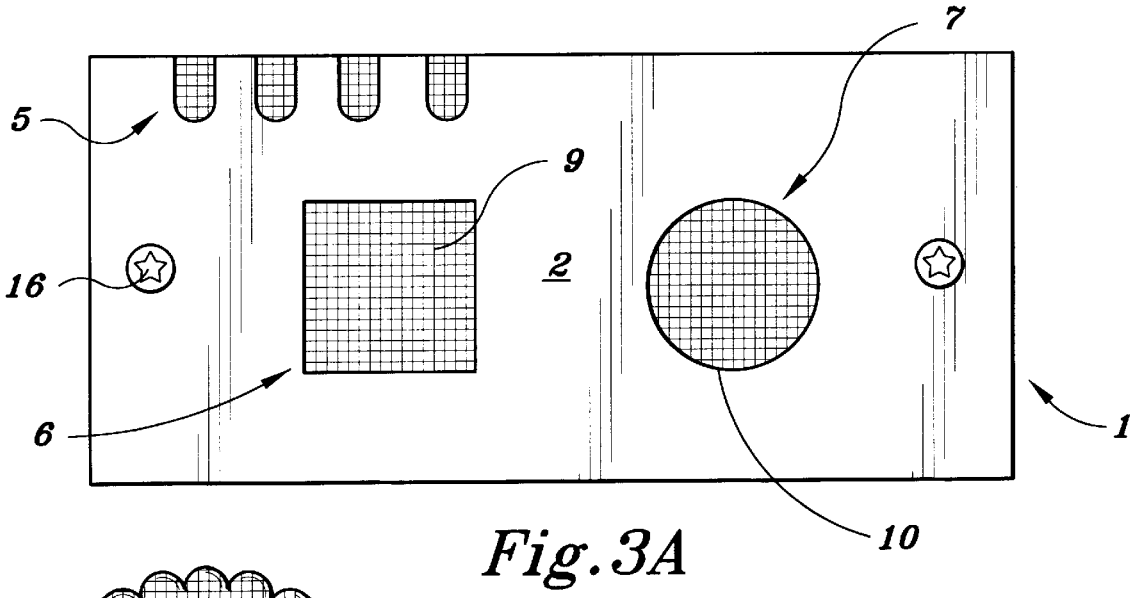
FIG. 3A is a front view of a fully assembled identification plate according to the present invention.
Figure 3B:
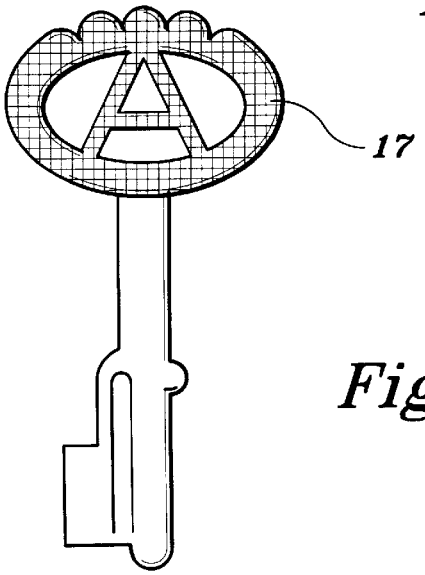
FIG. 3B is a side view of a key with the appropriate color and notches associated with the identification plate assembly shown in FIG. 3A according to the present invention.

FIGS. 3A and 3B show an identification plate 1 (FIG. 3A) and the corresponding key 17 (FIG. 3B) that the identification plate 1 indentifies. The color of the head of the key 17 matches the color in the configured openings 8,9,10 of the face plate 2 and the number of grooves (notches) on the head of the key 17 matches the number of grooves in the upper left corner of the identification plate 1.

Referring to FIGS. 3A and 3B, the components of the identification plate assembly 1 are secured to one another using security screws 16 that are only removable using a specific screw driver supplied by the manufacturer of the security screws 16. The security screws 16 prevent tampering and unauthorized modification of the identification plate 1.

Figure 4:
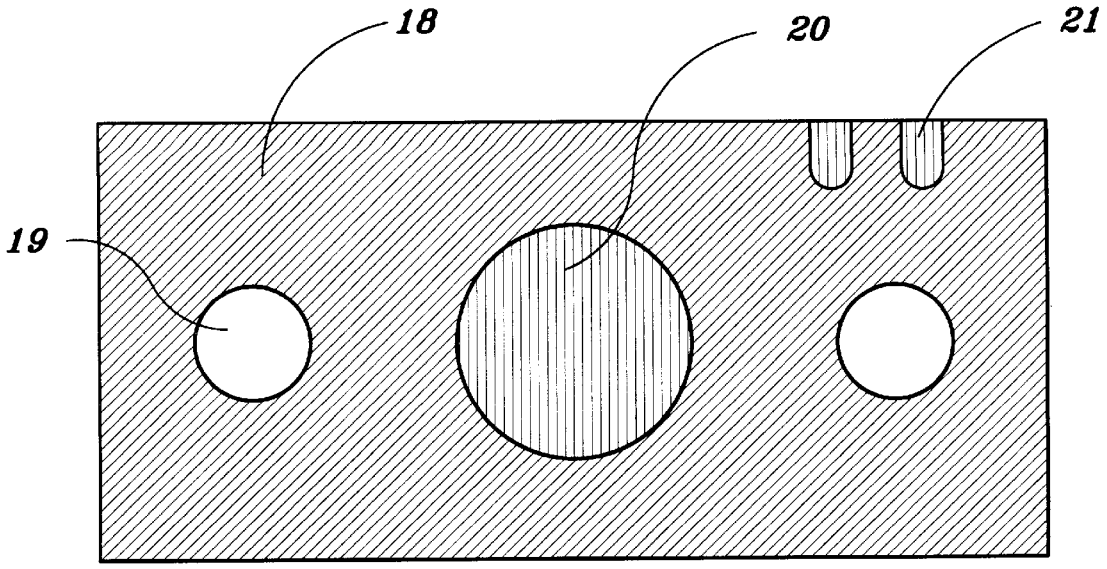
FIG. 4 is a front view of an alternate embodiment of a fully assembled identification plate assembly according to the present invention.

FIG. 4 shows an alternate embodiment of the present invention where the tactile identifier 21 is located in the upper right corner of the identification plate 1 instead of the upper left corner and there is a configured opening 20 in the center of the face plate 18. FIG. 4 also shows the location of the security screws 19.

Figure 6A:
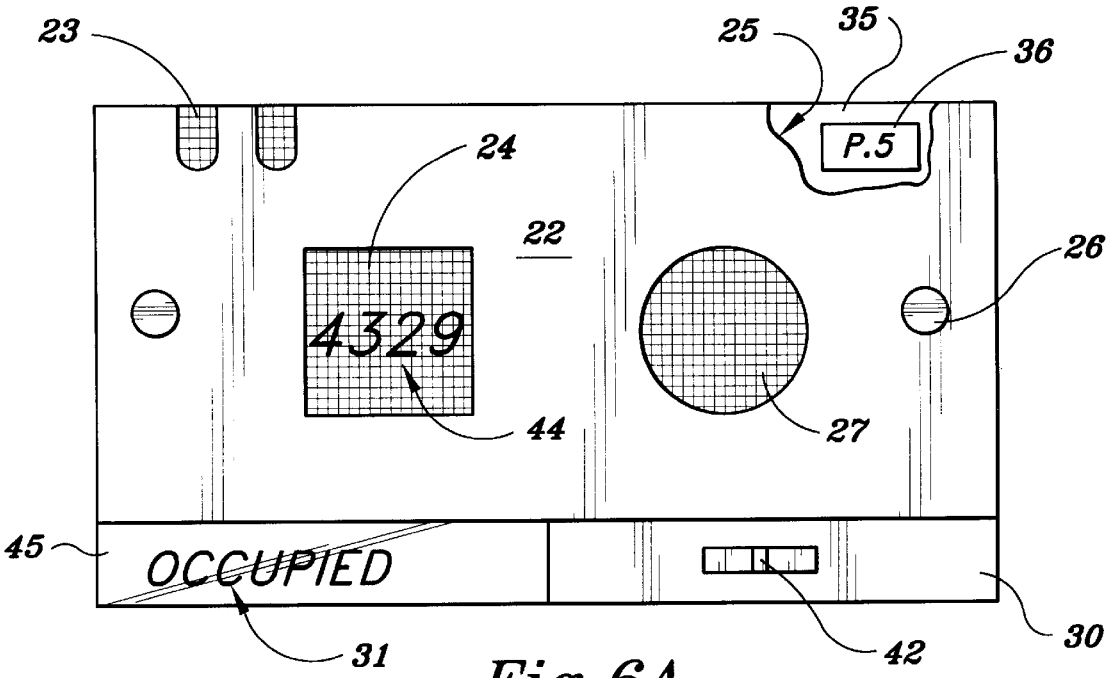
FIG. 6A is a front view of a third alternate embodiment of a fully assembled identification plate assembly with an occupancy indicator in the occupied position and a portion of the upper right hand corner of the face plate cutaway to reveal a label on the piece of clear plastic behind the face plate that shows the key number of the key for that door.
Figure 6B:
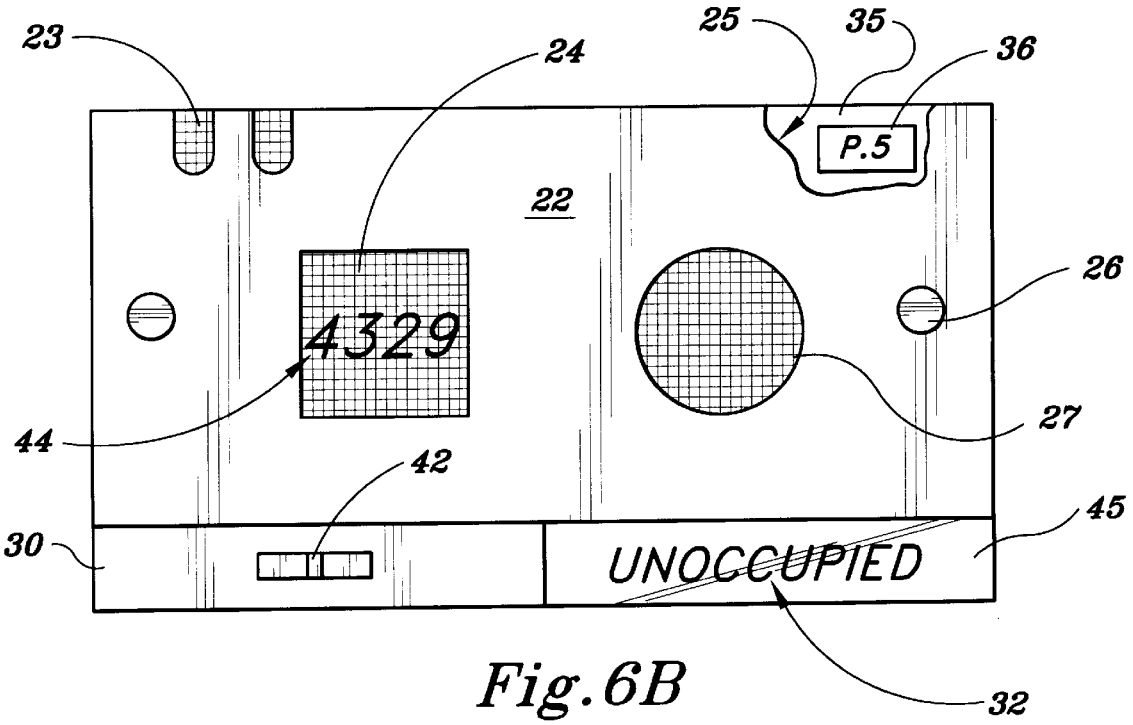
FIG. 6B is the same view depicted in FIG. 6A with the occupancy indicator in the unoccupied position.

FIGS. 6A and 6B show a front view of the embodiment depicted in FIG. 7. In both FIGS. 6A and 6B, a portion 25 of the face plate 22 is cutaway to reveal the underlying clear plastic 35 which has a label bearing the key number 36. This embodiment enables authorized personnel to quickly and easily obtain the key number 36 of the key for a specific door by simply removing the right security screw 26 and peering behind the face plate 22.

FIGS. 6A and 6B also show the configured openings 23,24,27 of the face plate 22, a label 44 in the square configured opening 24 bearing the room number, the bottom portion 45 of the front clear plastic 35 behind the face plate 22, and the handle 42 of the small movable plate 30 which is used to change the position of the movable plate 30 to indicate the occupancy status of the room to which access is sought.

In a preferred embodiment, the colors and numbers are placed directly on the front surface of the back plate 4; however, in an alternate embodiment, the colors and numbers are placed on a piece of paper (not shown) cut to the appropriate dimensions and placed either between the back plate 4 and the clear plastic center 3 or between the back plate 4 and the preceding piece of clear plastic 34. Placing the colors and the numbers on the surface of the back plate 4 is preferable if the colors and numbers are only changed infrequently, whereas placing the colors and numbers on a separate piece of paper that is readily changeable is preferable if the colors and numbers are frequently changed.

The applicability of the present invention is not limited to prisons but is applicable wherever there is a need for secured and/or controlled access, for example, airports, factories, schools, laboratories, company headquarters, government buildings, and military installations. It should be understood by those skilled in the art that various modifications and adaptations as well as alternative embodiments may be contemplated.

The preferred embodiments of the present invention disclosed herein are intended to be illustrative only and are not intended to limit the scope of the invention. It is to be understood that the present invention is not limited to the embodiments described above, but encompasses any and all embodiments within the scope of the following claims.

I claim:

1. An emergency color and tactile coded identification plate assembly comprising:

a face plate having configured openings, a clear plastic center, and a back plate having configured markings;

said configured markings of said back plate filling said configured openings of said face plate when said face plate, said clear plastic center, and said back plate are aligned and brought into contact with each other to form a single unit;

said single unit being held together using security screws;

said configured markings of said back plate being placed on a piece of paper cut to the appropriate dimensions instead of on the front surface of said back plate; and said piece of paper being placed between said clear plastic center and said back plate.

2. An emergency color and tactile coded identification plate assembly comprising:

a face plate having configured openings, a clear plastic center, and a back plate having configured markings;

said configured markings of said back plate filling said configured openings of said face plate when said face plate, said clear plastic center, and said back plate are aligned and brought into contact with each other to form a single unit:

said single unit being held together using security screws;

said clear plastic center is replaced by a long front clear plastic piece, a long back clear plastic piece, and labels; and said labels are sandwiched between the bottom portions of said long front clear plastic piece and said long back clear plastic piece.

3. An emergency color and tactile coded identification plate assembly with a status indicator comprising:

a face plate having configured openings, a long front clear plastic piece having an elongated slot, a small movable plate with a handle, a short intermediate clear plastic piece, a long intermediate clear plastic piece, a long back clear plastic piece, status labels, and a back plate having configured markings;

said configured markings of said back plate filling said configured openings of said face plate when said face plate, said long front clear plastic piece, said short intermediate clear plastic piece, said long intermediate clear plastic piece, said long back clear plastic piece, and said back plate are aligned and brought into contact with each other to form a single unit;

said status labels are sandwiched between the bottom portions of said long intermediate clear plastic piece and said long back clear plastic piece, and said movable plate is sandwiched between the bottom portions of said long front clear plastic piece and said long intermediate clear plastic piece; and said handle of said movable plate extends through said elongated slot of said long front clear plastic piece.

4. An emergency color and tactile coded identification plate assembly with a status indicator according to claim 3 wherein:

said single unit is held together using security screws.

5. A method for matching a key with a locked door that the key opens, the key having a visual identifier and a tactile identifier, and the door including an identification plate having a visual identifier and a tactile identifier, said method comprising:

matching the visual identifier of the key with the visual identifier of the identification plate or matching the tactile identifier of the key with the tactile identifier of the identification plate;

the identification plate comprising a face plate having configured openings, a clear plastic center, and a back plate having configured markings;

the configured markings of said back plate filling said configured openings of said face plate when said face plate, said clear plastic center, and said back plate are aligned and brought into contact with each other to form a single unit.

6. A method for matching a key with the lock that the key opens according to claim 5 wherein:

said single unit is held together using security screws.

7. A method for matching a key with the lock that the key opens according to claim 5 wherein:

said identification plate has a status indicator;

replacing said clear plastic center with multiple clear plastic pieces of different heights and thicknesses such that said identification plate with said status indicator comprises a face plate having configured openings, a long front clear plastic piece having an elongated slot, a small movable plate with a handle, a short intermediate clear plastic piece, a long intermediate clear plastic piece, status labels, a long back clear plastic piece, and a back plate having configured markings;

said configured markings of said back plate filling said configured openings of said face plate when said face plate, said long front clear plastic piece, said short clear plastic intermediate piece, said long intermediate clear plastic piece, said long back clear plastic piece, and said back plate are aligned and brought into contact with each other to form a single unit;

said status labels are sandwiched between the bottom portions of said long intermediate clear plastic piece and said long back clear plastic piece, and said movable plate is sandwiched between the bottom portions of said long front clear plastic piece and said long intermediate clear plastic piece; and said handle of said movable plate extends through said elongated slot of said long front clear plastic piece.

8. A method for matching a key with the lock that the key opens according to claim 7 wherein:

said single unit is held together using security screws.

* * * * *